US012013203B2

(12) United States Patent
Zeman

(10) Patent No.: US 12,013,203 B2
(45) Date of Patent: Jun. 18, 2024

(54) AMMUNITION FEED CONTROL SYSTEM FOR FIREARM

(71) Applicant: Bryan Zeman, Lake Havasu City, AZ (US)

(72) Inventor: Bryan Zeman, Lake Havasu City, AZ (US)

( * ) Notice: Subject to any disclaimer, the term of this patent is extended or adjusted under 35 U.S.C. 154(b) by 0 days.

(21) Appl. No.: 17/805,252

(22) Filed: Jun. 3, 2022

(65) Prior Publication Data

US 2023/0392889 A1 Dec. 7, 2023

(51) Int. Cl.
*F41A 9/55* (2006.01)

(52) U.S. Cl.
CPC ..... *F41A 9/55* (2013.01)

(58) Field of Classification Search
CPC ..... F41A 9/54; F41A 9/55; F41A 9/56; F41A 9/58
See application file for complete search history.

(56) References Cited

U.S. PATENT DOCUMENTS

| | | | | |
|---|---|---|---|---|
| 2,402,581 | A * | 6/1946 | Ruau | F41A 9/58 89/24 |
| 2,585,738 | A * | 2/1952 | Chapin | F41A 9/55 42/25 |
| 3,177,603 | A * | 4/1965 | Gillespie | F41A 21/484 42/75.02 |
| 4,242,825 | A * | 1/1981 | deBoer | F41A 9/58 42/76.01 |
| 6,276,252 | B1 * | 8/2001 | Dionne | F41A 3/86 89/14.05 |
| 9,194,641 | B2 * | 11/2015 | Young | F41A 21/485 |
| 10,782,080 | B1 * | 9/2020 | Mitchell | F41A 21/48 |
| 10,788,276 | B2 | 9/2020 | Satern | |
| 11,092,396 | B1 * | 8/2021 | Sugg | F41A 9/55 |
| 2013/0061501 | A1 * | 3/2013 | Pflaumer | F41A 9/55 42/2 |
| 2014/0237878 | A1 * | 8/2014 | Lambert | F41A 3/66 42/75.01 |
| 2015/0316336 | A1 * | 11/2015 | Lee | F41A 3/38 42/16 |
| 2016/0195350 | A1 * | 7/2016 | Packard | F41A 9/55 42/6 |
| 2016/0258699 | A1 * | 9/2016 | Sigler | F41A 21/482 |
| 2018/0347924 | A1 * | 12/2018 | Satern | F41A 9/55 |

FOREIGN PATENT DOCUMENTS

| | | | | |
|---|---|---|---|---|
| DE | 3818838 A1 | | 12/1989 | |
| GB | 191312579 A | * | 6/1914 | F41A 11/02 |
| RU | 2499966 C1 | * | 11/2013 | F41A 9/38 |

* cited by examiner

*Primary Examiner* — Derrick R Morgan
(74) *Attorney, Agent, or Firm* — Wood Herron & Evans LLP

(57) ABSTRACT

Provided is a cartridge feed guide particularly useful for a pistol-caliber firearm with a blow-back bolt. It includes a barrel with a chamber with an open entrance to receive a cartridge. A guide member is situated rearward of the chamber entrance and has a pair of generally upwardly extending and laterally spaced apart pillars configured to guide a cartridge being pushed by the bolt from a magazine by limiting lateral angular of the cartridge. The guide member can also provide a fulcrum on which a vertical angle of the cartridge pivots as it is being chambered.

7 Claims, 3 Drawing Sheets

AMMUNITION FEED CONTROL SYSTEM FOR FIREARM

TECHNICAL FIELD

This invention relates to a system for controlled feeding of ammunition cartridges in a firearm. In particular, it provides a guide element that creates a tilting fulcrum and prevents lateral divergence and other types of misfeeding for larger caliber pistol cartridges, especially in pistol caliber carbines.

BACKGROUND

An AR-pattern pistol caliber carbine (PCC) typically uses a blow-back bolt and pistol ammunition magazines. While 9 mm Luger caliber cartridges usually reliably feed from the magazine into the chamber, there can be feed reliability issues with PCCs adapted for larger caliber pistol cartridges, such as .45 ACP and 10 mm calibers. These larger calibers have cartridges in which the diameter to length ratio is different from that of the 9 mm Luger. Moreover, the relatively fatter/shorter cartridges are being fed into a larger diameter chamber opening. This dimensional combination can allow the cartridge to misfeed (and not properly enter the chamber). This feed reliability problem might not occur if the larger caliber (diameter) cartridges were proportionately longer in overall length (AOL) and is not found to be a problem with rifle caliber cartridges (which are significantly longer). The proportional dimensions of the commonly used .45 ACP and 10 mm pistol caliber cartridges, for example, however, seem to exhibit this problem in existing designs.

As the cartridge is being stripped from the magazine and pushed forward into the chamber by the bolt, the vertical angle (longitudinal vertical plane) of the cartridge must shift. Once free of the magazine feed lips, the cartridge is being pushed by the bolt face with contact against only one edge point of the rim and, if unguided, can deviate in any up/down or left/right direction. If the angle of the nose is too steep or the base/head of the cartridge yaws to one side, the cartridge may not enter the chamber and may jam, requiring manual cycling of the bolt and ejection (loss) of an unfired cartridge. This problem can be exacerbated when flat nosed or hollow point projectile cartridges are used.

Pistols (which use a reciprocating slide, as compared to AR-pattern PCCs that use a blow-back bolt adapted for the AR platform) often use a lower feed ramp at the mouth of the chamber. This type of feed ramp does little (if anything) to prevent lateral misfeeding, because such does not pose a significant problem in pistols. Thus, adapting the common pistol feed ramp to the AR-pattern PCC will not address the problems encountered there with the larger caliber cartridges. Extending a feed ramp around the lower half or all of the chamber entrance also will not solve the problem. Even a conical chamber entrance alone is not effective for the larger caliber pistol caliber cartridges, which have a significantly different length to diameter ratio and a significantly larger diameter chamber.

SUMMARY OF THE INVENTION

The present invention provides a cartridge feed guide for a pistol-caliber firearm. A guide member is situated rearward of a barrel chamber entrance that receives a cartridge. The guide member has a pair of generally upwardly extending and laterally spaced apart pillars configured to guide a cartridge being pushed by the bolt from a magazine by providing a fulcrum for vertical tipping and limiting lateral angular misalignment of the cartridge.

An imaginary vertical plane along the central axis of the chamber/bore can represent orientation of a cartridge along the X and Y axes. Lateral angular orientation of the cartridge represents movement on the Z axis and introduces a third dimension of potential orientation/misorientation. The present invention effectively eliminates the potential third dimension (Z axis) orientation misalignment and reduces the handling of the cartridge to two axes (X and Y). As the cartridge is pushed by the bolt at a top edge of the cartridge rim or base and the nose of the projectile bears against an upper surface of the chamber entrance, the guide member provides a fulcrum about which the cartridge will pivot in the vertical plane. As the cartridge is pushed further forward over the guide member, more of the cartridge is moved forward of the fulcrum point. As such, the alignment/orientation of the cartridge during feeding and chambering is better and more reliably controlled. A conical chamber entrance controls the nose of the cartridge while pillars simultaneously control the base end, laterally centering the base to the bolt face and enacting the upward tilt into it.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
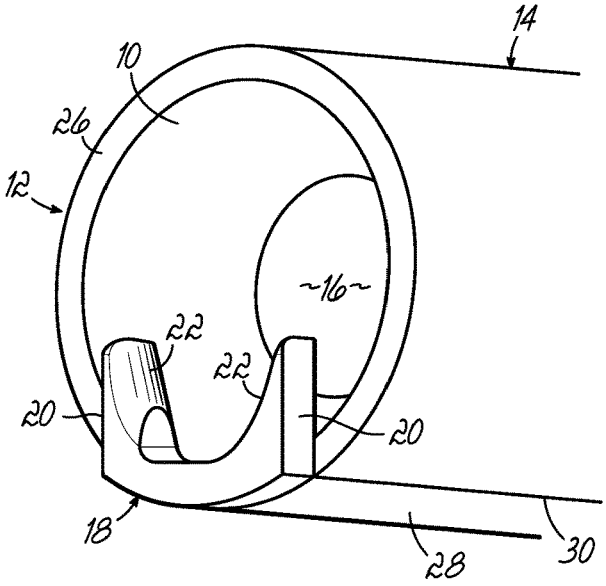
FIG. 1 is an isometric view showing a chamber opening and guide members according to features of an embodiment of the invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Figure 3:
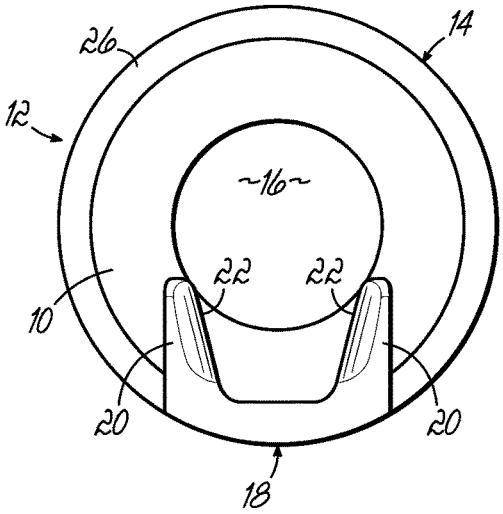
FIG. 3 is end elevation view of the structure shown in FIG. 1.

Referring first to FIGS. 1 and 3, therein is shown the chamber entrance at the breach end 12 of a PCC barrel 14. The illustrated embodiment is adapted for .45 ACP caliber ammunition, but the inventive concept applies and is adaptable to other larger-diameter pistol calibers, such as 10 mm. The chamber 16 may be integral with the barrel 14 or be part of a barrel extension, as is well-known for the AR-pattern platform.

The present invention provides a controlled feed system with a guide 18 positioned adjacent the breach end 12 of the barrel 14, at or near the chamber entrance 10. The guide 18 provides a laterally spaced apart pair of generally upwardly extending projections or prongs, referred to herein as "pillars" 20. Rear inward edges 22 of the pillars 20 may be cammed or beveled to facilitate guiding a cartridge 24 into the chamber 16. As shown in FIG. 3, the pillars 20 may be laterally spaced apart less than the diameter of the chamber 16. The guide 20 may be positioned at the rearward edge 26 of the chamber entrance 10 or may be spaced forwardly or rearwardly of the edge 26. The base of the guide 18, connecting the pillars 20, may present a curved bight, which may or may not also include a cammed or beveled edge. As best illustrated in FIG. 3, the cammed edges 22 of the pillars 20 may be slightly angled outwardly relative to vertical. This can assist in proper vertical positioning of the cartridge 24 as it advances forward toward and into the chamber 16. In the illustrated embodiment, the pillars 20 are not angled toward forward or rear, but such modification can be employed, if desired. The vertical height or top of the pillars 20 is usually lower than the axial midpoint of the chamber 16. The guide 18 may be manufactured and/or assembled as an insert piece. For example, an extension 28 may be fitted into a slot or recess 30 in the barrel 14. The guide 18 may be machined, or it may be made by MIM or an additive manufacturing (3D printing) process.

As further explained below, the guide 18 guides a cartridge 24 as it is being fed into the chamber 16 to effectively prevent lateral angular displacement (i.e., the Z axis or $3^{rd}$ dimension) and to provide a vertical tipping fulcrum for the cartridge 24 as it is pushed forward. The conical chamber entrance 10 provides an annular feed ramp. The guide 18 may make the lateral feed ramp aspect of the conical chamber entrance unnecessary, but it is easier to manufacture annularly. This conical chamber entrance may be able to redirect cartridges when the nose end has deviated, such as laterally, but is not effective when the base end of the cartridge has deviated.

A typical, known blow-back bolt for an AR-pattern PCC (not shown) has a flat face with a recess for holding the head of a cartridge. An extractor holds the cartridge rim and an ejector is fixed to the lower receiver to project upwardly (and forwardly) in the left side groove on the bottom of the bolt.

Figure 2:
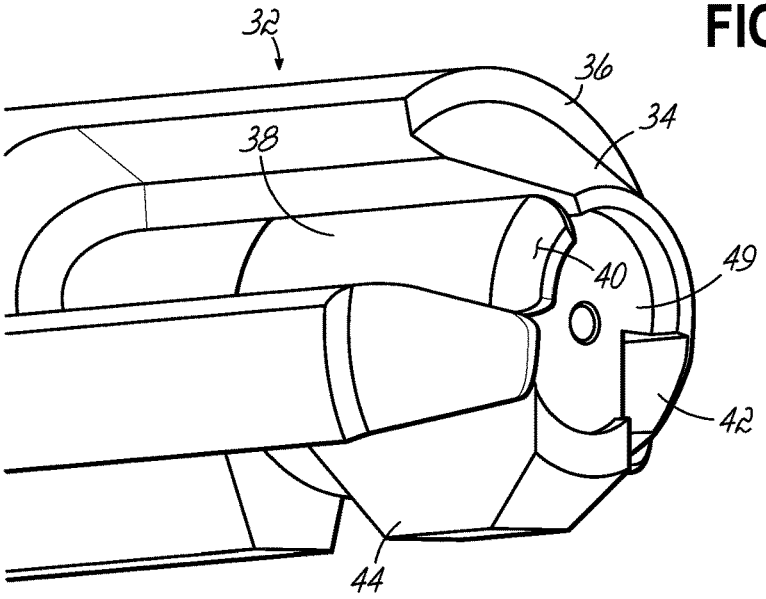
FIG. 2 is an isometric view of the nose of a bolt according to features of an embodiment of the invention.

Referring now also to FIG. 2, therein is shown a blow-back bolt 32 nose design according to one embodiment or aspect of the present invention. The conical nose 34 is received by the conical chamber entrance 10 of the breach end 12 of the barrel 14 when the bolt 32 is in battery. An annular shoulder 36 can abut the annular edge 26 of the barrel 14. The extractor 38 may include a beveled outer forward surface 40 to conform to the conical taper of the bolt nose 34 and barrel recess 10 when a cartridge rim 48 is engaged. The lower grooves 42, 44 that accommodate passage over magazine lips (and ejector, not shown) also receive the guide pillars 20 when the bolt is in battery. The bolt face includes a recess 49 for receiving the head of the cartridge 24. The wall defining the recess 49 may be lower at the bottom portion. This, in combination with the action more fully described below, allows the cartridge rim to slide into the recess 49 and engagement with the extractor 38, rather than require the extractor 38 to snap over the rim after the cartridge 24 is chambered. The conical chamber entrance 10 controls the nose of the cartridge 24 while the pillars 20 simultaneously control the base end, laterally centering the base to the bolt face and enacting the upward tilt into it.

Figure 4A:
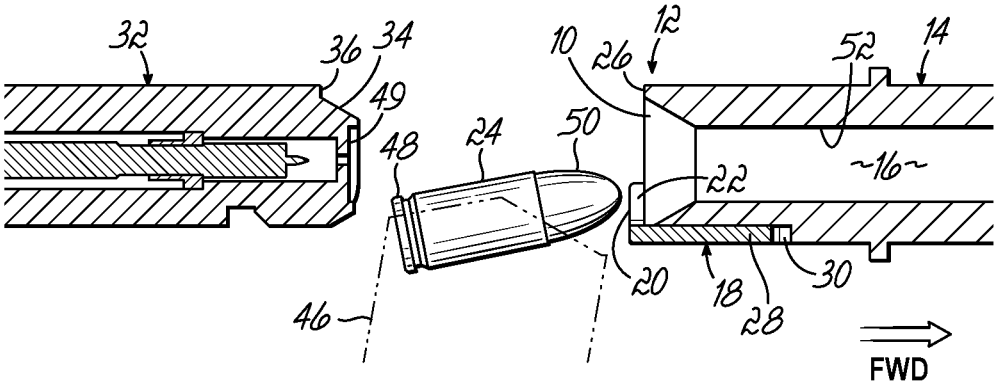
FIGS. 4A-F schematically show a series of successive side views representing the movement of the bolt and a cartridge being chambered.

Referring now to FIGS. 4A-F and first to FIG. 4A, therein is schematically shown the position of the barrel 14, chamber 16, bolt 32, and a cartridge 24 being held in the feed lips of a pistol caliber magazine 46. The bolt 32 is shown in a retracted position in FIG. 4A.

Figure 4B:
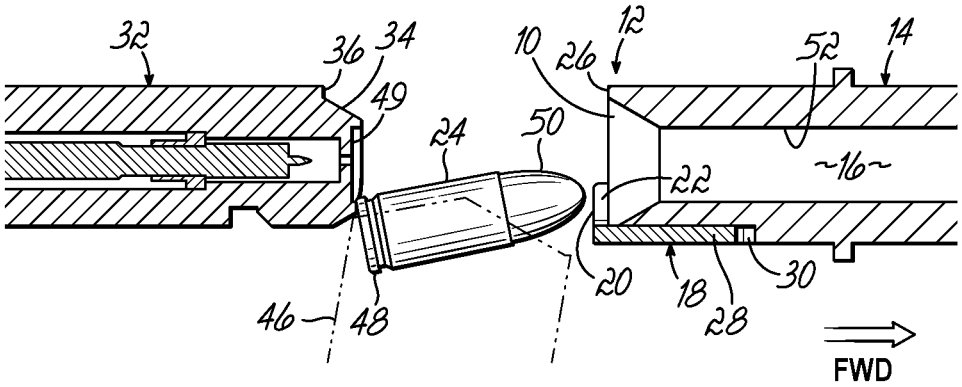
Figure 4C:
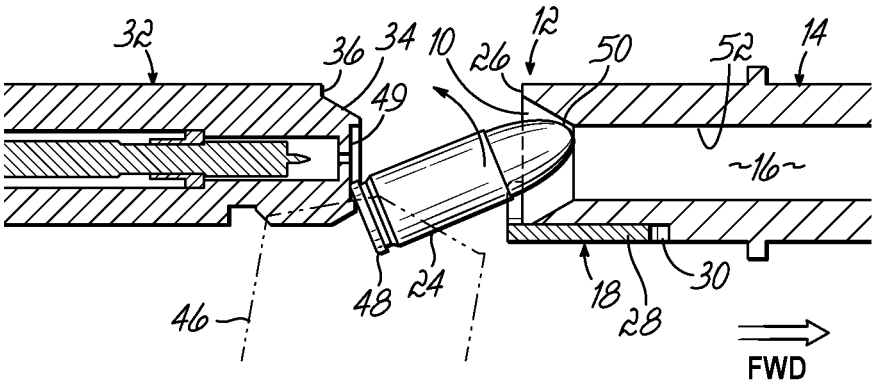

Referring now to FIG. 4B, therein the bolt 32 is shown as it is traveling forward to make contact with a top edge portion of the rim 48 of the cartridge 24 as a first step in chambering a round. FIG. 4C shows the bolt 32 advancing forward and stripping the cartridge 24 from the magazine 46. The nose 50 of the cartridge enters the chamber entrance 10 and is rotated upwardly by contact with the guide 18, usually causing the nose 50 to contact an upper part of the conical chamber entrance 10. Beginning at this stage, lateral displacement of the cartridge 24 is prevented by lateral guidance from the pillars 20.

Figure 4D:
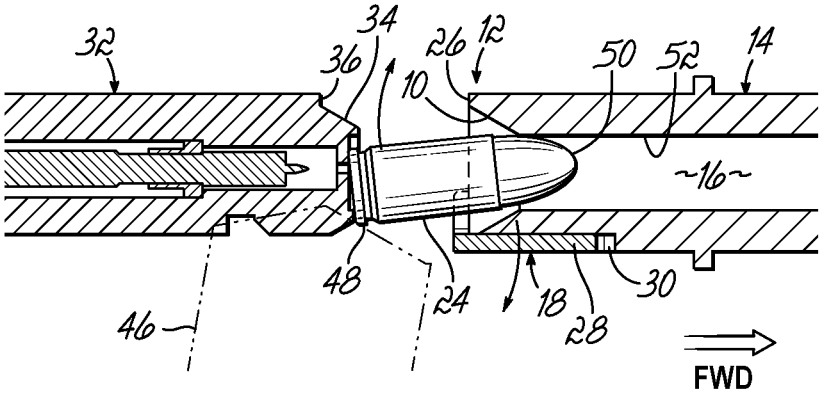
Figure 4E:
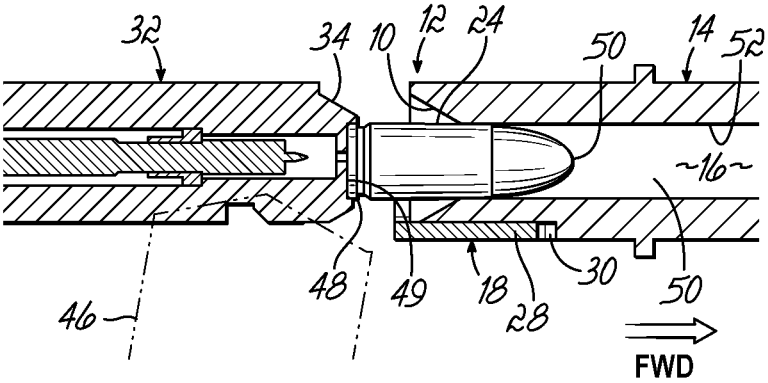

Referring now to FIG. 4D, as the cartridge 24 is advanced forward, a nose portion 50 moves into and makes contact with an upper edge 52 of the chamber 16. The cartridge 24 is still being guided between the pillars 20 of the guide 18 and the base slides upwardly into engagement with the bolt face 49. Referring now to FIG. 4E, as the cartridge 24 begins to enter the chamber 16, the cartridge nose portion 50 tips downwardly, causing the head or rim 48 end to rotate upwardly toward axial alignment with the chamber 16. Movement of the cartridge 24 is restricted to two dimensions (X axis—forward/rear and Y axis—up/down). Lateral skewing (yaw) in the third dimension (Y axis) is prevented by the guide 18. At this stage, the guide 18 finishes its purpose and the cartridge 24 is guided by the chamber 16 itself.

Figure 4F:
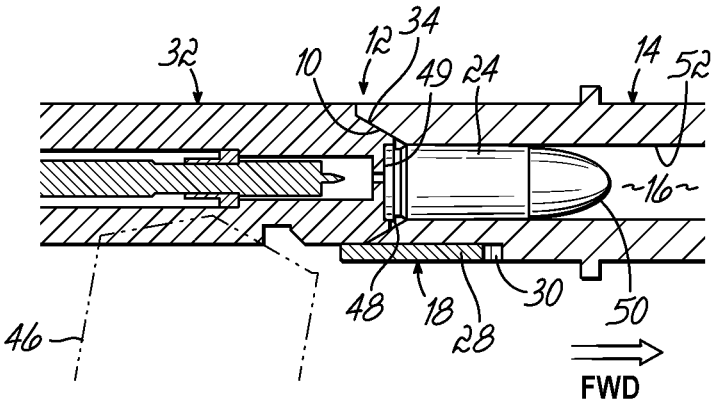

FIG. 4F shows the cartridge 24 fully chambered and the bolt 32 at the fully in-battery position. The conical nose 34 of the bolt 32 is seated in the conical chamber entrance 10 and the bolt's annular shoulder 36 seats against the edge 26 of the chamber entrance 10. The cartridge 24 is fully supported.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A pistol-caliber carbine firearm having a cartridge feed guide, comprising:

a blow-back bolt;

a barrel with a chamber to receive a cartridge, the chamber having an open entrance; and a guide member situated rearward of the chamber entrance, assembled to the barrel by an extension received within a recess of the barrel, and having a pair of generally upwardly extending and laterally spaced apart pillars having a height that exceeds a forward/aft dimension of the pillars, the pillars positioned to guide a cartridge being pushed by the bolt from a magazine by limiting lateral angular of the cartridge.

2. The feed guide of claim 1, wherein the pillars include cam surfaces on inward rear edges thereof.

3. The feed guide of claim 1, wherein the barrel includes an annular substantially conical entrance to the chamber.

4. The feed guide of claim 3, further comprising a bolt with a substantially conical nose portion.

5. In a pistol-caliber firearm with a blow-back bolt, a cartridge feed guide, comprising:

a barrel with a chamber to receive a cartridge, the chamber having an open entrance;

a guide member situated rearward of the chamber entrance and having a pair of generally upwardly extending and laterally spaced apart pillars positioned to guide a cartridge being pushed by the bolt from a magazine by limiting lateral angular of the cartridge, wherein the barrel includes an annular substantially conical entrance to the chamber, and further comprising an extractor arm configured with a surface substantially conforming to the conical nose portion.

6. The feed guide of claim 4, wherein the substantially conical nose portion of the bolt mates with the annular substantially conical entrance to the chamber when in battery.

7. In a pistol-caliber firearm with a blow-back bolt, a cartridge feed guide, comprising:

a barrel with a chamber to receive a cartridge, the chamber having an open entrance;

a guide member situated rearward of the chamber entrance and having a pair of generally upwardly extending and laterally spaced apart pillars positioned to guide a cartridge being pushed by the bolt from a magazine by limiting lateral angular of the cartridge, wherein the barrel includes an annular substantially conical entrance to the chamber further comprising a bolt with a substantially conical nose portion wherein the substantially conical nose portion of the bolt mates with the annular substantially conical entrance to the chamber when in battery, and wherein the bolt and chamber entrance both include mating annular shoulder surfaces at outer edges thereof.

* * * * *